US006685537B1

(12) United States Patent
Fruitman et al.

(10) Patent No.: US 6,685,537 B1
(45) Date of Patent: Feb. 3, 2004

(54) POLISHING PAD WINDOW FOR A CHEMICAL MECHANICAL POLISHING TOOL

(75) Inventors: Clinton O. Fruitman, Chandler, AZ (US); Mark A. Meloni, Louisville, TX (US); Periya Gopalan, Chandler, AZ (US); Andrew Yednak, III, Phoenix, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 441 days.

(21) Appl. No.: 09/587,593

(22) Filed: Jun. 5, 2000

(51) Int. Cl.[7] ..... B24B 49/00

(52) U.S. Cl. ..... 451/6; 451/41; 451/527; 451/548; 51/289

(58) Field of Search ..... 451/6, 41, 527, 451/548; 51/298

(56) References Cited

U.S. PATENT DOCUMENTS

| | | | | |
|---|---|---|---|---|
| 5,329,734 A | | 7/1994 | Yu | |
| 5,433,651 A | | 7/1995 | Lustig et al. | |
| 5,549,962 A | | 8/1996 | Holmes et al. | |
| 5,605,760 A | | 2/1997 | Roberts | |
| 5,838,447 A | | 11/1998 | Hiyama et al. | |
| 5,893,796 A | | 4/1999 | Birang et al. | |
| 5,949,927 A | | 9/1999 | Tang | |
| 6,086,799 A | * | 7/2000 | Buazza et al. | 264/1.38 |
| 6,102,775 A | * | 8/2000 | Ushio et al. | 451/6 |
| 6,172,756 B1 | * | 1/2001 | Chalmers et al. | 356/630 |
| 6,228,289 B1 | * | 5/2001 | Powers et al. | 264/1.36 |
| 6,271,047 B1 | * | 8/2001 | Ushio et al. | 438/14 |
| 6,458,014 B1 | * | 10/2002 | Ihsikawa et al. | 451/6 |
| 2001/0039064 A1 | * | 11/2001 | Ushio et al. | 438/14 |
| 2002/0001862 A1 | * | 1/2002 | Ushio et al. | 438/14 |
| 2002/0013124 A1 | * | 1/2002 | Tsujimura et al. | 451/138 |

FOREIGN PATENT DOCUMENTS

| | | |
|---|---|---|
| EP | 0 663 265 A1 | 7/1995 |
| EP | 0 738 561 A1 | 10/1996 |
| EP | 0 824 995 A1 | 2/1998 |
| EP | WO 98/30356 | 7/1998 |
| EP | 0 893 203 A2 | 1/1999 |
| EP | 0 941 806 A2 | 9/1999 |

* cited by examiner

*Primary Examiner*—M Rachuba
(74) *Attorney, Agent, or Firm*—Ingrassia, Fisher & Lorenz P.C.

(57) ABSTRACT

The present invention is an apparatus and method for manufacturing a window into a polishing pad used during a planarization process of a front surface of a wafer. A hole is created in the polishing pad at a location where a window is desired. A first release film may be pressed against the working surface of the polishing pad thereby covering one end of the hole. Window material of suitable mechanical, chemical and optical properties is cast in the hole. A second release film may also be pressed against the bottom surface of the polishing pad covering the other end of the hole. The window material is preferably cured with light to quickly form and bond the window into the hole. The release films may be removed leaving the cast window in the polishing pad.

28 Claims, 4 Drawing Sheets

POLISHING PAD WINDOW FOR A CHEMICAL MECHANICAL POLISHING TOOL

TECHNICAL FIELD

The present invention relates generally to chemical-mechanical planarization apparatus used in manufacturing semiconductors and more specifically to an improved polishing pad that allows in situ monitoring of a wafer during a chemical-mechanical polishing process.

BACKGROUND OF THE INVENTION

A flat disk or "wafer" of single crystal silicon is the basic substrate material in the semiconductor industry for the manufacture of integrated circuits. Semiconductor wafers are typically created by growing an elongated cylinder or boule of single crystal silicon and then slicing individual wafers from the cylinder. The slicing causes both faces of the wafer to be extremely rough. The front face of the wafer on which integrated circuitry is to be constructed must be extremely flat in order to facilitate reliable semiconductor junctions with subsequent layers of material applied to the wafer. Also, the material layers (deposited thin film layers usually made of metals for conductors or oxides for insulators) applied to the wafer while building interconnects for the integrated circuitry must also be made a uniform thickness.

Planarization is the process of removing projections and other imperfections to create a flat planar surface, both locally and globally, and/or the removal of material to create a uniform thickness for a deposited thin film layer on a wafer. Semiconductor wafers are planarized or polished to achieve a smooth, flat finish before performing lithographic process steps that create integrated circuitry or interconnects on the wafer. A considerable amount of effort in the manufacturing of modem complex, high density multilevel interconnects is devoted to the planarization of the individual layers of the interconnect structure. Nonplanar surfaces create poor optical resolution of subsequent photolithographic processing steps. Poor optical resolution prohibits the printing of high density features. Another problem with nonplanar surface topography is the step coverage of subsequent metalization layers. If a step height is too large there is a serious danger that open circuits will be created. Planar interconnect surface layers are required in the fabrication of modem high-density integrated circuits. To this end, CMP tools have been developed to provide controlled planarization of both structured and unstructured wafers.

CMP consists of a chemical process and a mechanical process acting together, for example, to reduce height variations across a dielectric region, clear metal deposits in damascene processes or remove excess oxide in shallow trench isolation fabrication. The chemical-mechanical process is achieved with a liquid medium containing chemicals that react with the front surface of the wafer when it is mechanically stressed during the planarization process.

In a conventional CMP tool for planarizing a wafer, a wafer is secured in a carrier connected to a shaft. The shaft is typically connected to mechanical means for transporting the wafer between a load or unload station, and a position adjacent to a polishing pad mounted to a rigid or flexible platen. Pressure is exerted on the back surface of the wafer by the carrier in order to press the wafer against the polishing pad, usually in the presence of slurry. The wafer and/or polishing pad are then moved in relation to each other via motor(s) connected to the shaft and/or platen in order to remove material in a planar manner from the front surface of the wafer.

It is often desirable to monitor the front surface of the wafer during the planarization process (in situ). One known method is to use an optical system that interrogates the front surface of the wafer in situ by positioning an optical probe under the polishing surface and transmitting and receiving the optical signal through an opening in the polishing pad. In some systems the opening in the polishing pad is filled with an optically transparent material, or "window", in order to prevent polishing slurry or other contaminants from being deposited into the probe and obscuring the optical path to the wafer. It is possible to adjust the planarization process based upon these real-time measurements or to terminate the process once the front surface of the wafer has reached a desired condition. However, several problems exist with current window technology. One such problem is that separations start to form at the surfaces between the window and the polishing pad when the polishing pad is stressed during the planarization process of the wafer. Even extremely small separations are undesirable as contamination can accumulate within the separations and scratch the front surface of the wafer or cause optical interference. Scratching and optical interference can also result from abrasive particles becoming trapped in the window material itself, or from the surface of the window projecting above the surrounding pad material. Another problem is that the optical clarity of the pad window can be degraded due to the presence of trapped gas bubbles within the window material. Still other problems include chemical degradation, staining, and poor optical clarity of the window. In addition, some windows may undesirably absorb some of the UV light spectra that offers the most ideal signal response in the monitoring process.

What is needed is a polishing pad window (or lens) that does not scratch the wafer, is chemically and stain resistant to the polishing environment, and that has good optical properties through which in situ CMP monitoring may be undertaken.

SUMMARY OF THE INVENTION

The present invention provides an improved polishing pad window for use during a planarization process of a front surface of a wafer and a method of manufacturing the window.

The method of manufacturing the polish pad window may include a degassing step in which the window material, polish pad or both are degassed in order to reduce the size and number of unwanted gas bubbles in the window, thereby improving the optical qualities of the window. The degassing may be accomplished by warming the window material and/or polishing pad or by using known vacuum techniques to release absorbed gasses in the window material and/or polishing pad.

A hole is created in the polishing pad at every location where a window is desired. The method for creating the hole is not critical, but should produce a hole with minimal fuzz or loose particles on the walls of the hole. The method for creating the holes is preferably able to accurately position the holes on the polishing pad without damaging or contaminating the polishing pad.

The process may be further improved by positioning a first release film against the working surface of the polishing pad over the hole. The first release film prevents the later inserted optically clear window material from draining out the hole and forms a top surface for the window.

If it is desired for the top surface of the window to be lower than the working surface of the polishing pad, a plug may be placed into the hole. This prevents the window material from becoming coplanar with the working surface of the polishing pad thereby recessing the top surface of the window. This may be necessary if the window material would scratch or damage the front surface of the wafer if the wafer touched the window.

The working surface of the polishing pad is preferably turned face down before the hole is filled with an optically clear window material. With the working surface face down, bubbles that form will travel away from the eventual top surface of the window and any adverse effects will be minimized. The optically clear window material is preferably curable with UV light to quickly set and bond the window into the hole.

Another improvement to the process is to position a second release film against the bottom surface of the polishing pad over the hole. The second release film helps to create a bottom surface for the window that is coplanar with the bottom surface of the polishing pad.

After the window has been cured and the first and second release films have been removed as needed, the top and bottom surface of the window may be conditioned to remove excess window material. In addition, it may be desirable to condition the window's surfaces so that its top and bottom surface are coplanar with the corresponding working surface and bottom surface of the polishing pad.

A polishing pad with a cured window cast in place may thus be created.

BRIEF DESCRIPTION OF THE DRAWINGS

The following drawings are illustrative of particular embodiments of the invention and therefore do not limit the scope of the invention, but are presented to assist in providing a proper understanding of the invention. The drawings are not to scale (unless so stated) and are intended for use in conjunction with the explanations in the following detailed description section. The present invention will hereinafter be described in conjunction with the appended drawing figures, wherein like numerals denote like elements, and.

DETAILED DESCRIPTION OF EXEMPLARY EMBODIMENTS

Figure 1A:
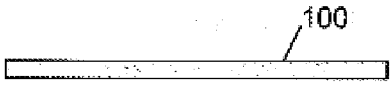
FIGS. 1*a* and 1*b* are a cross section and plan view of a typical polishing pad.
Figure 2A:
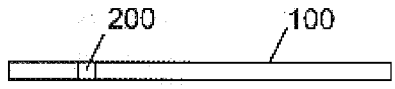
FIGS. 2*a* and 2*b* are a cross section and plan view of a polishing pad with a hole having a desired size and location.
Figure 1B:
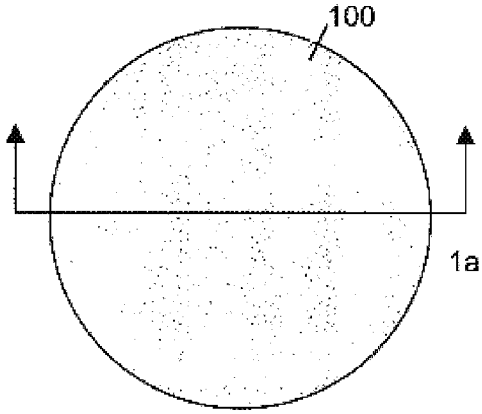
Figure 2B:
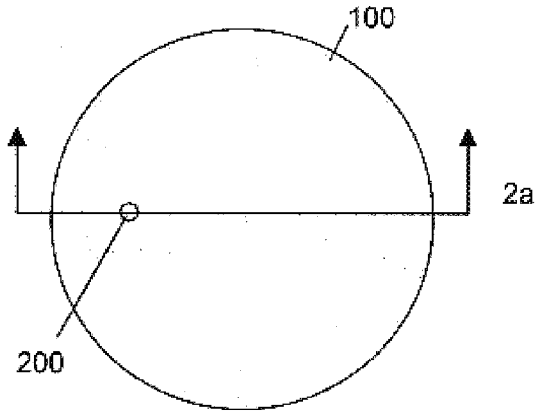
Figure 3A:
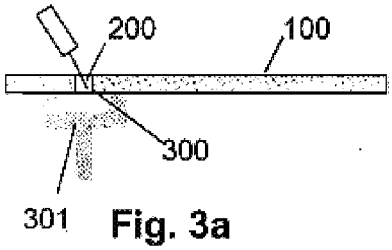
FIGS. 3*a* and 3*b* are a cross section and plan view of a release film held in place on the working surface of the polishing pad and an apparatus for injecting the window material into the hole.
Figure 4A:
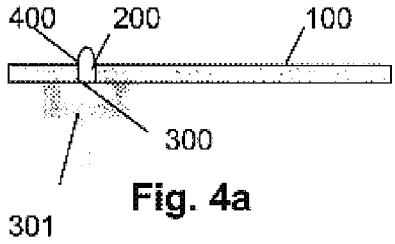
FIGS. 4*a* and 4*b* are a cross section and plan view of a hole in the polishing pad filled with the window material.
Figure 3B:
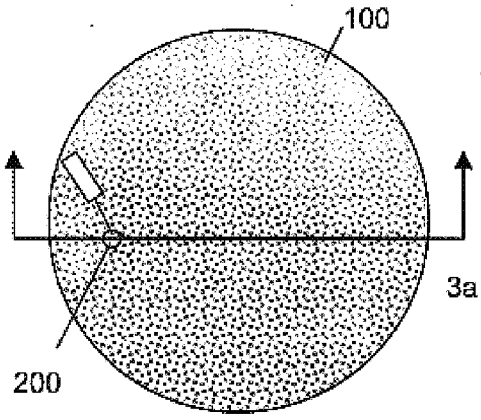
Figure 4B:
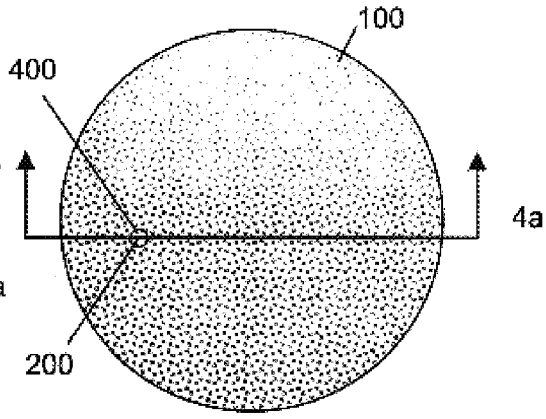
Figure 5A:
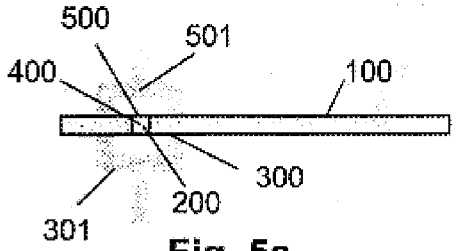
FIGS. 5*a* and 5*b* are a cross section and plan view of a hole in the polishing pad filled with window material with a release film held over the bottom of the hole and a release film held over the top of the hole.
Figure 6A:
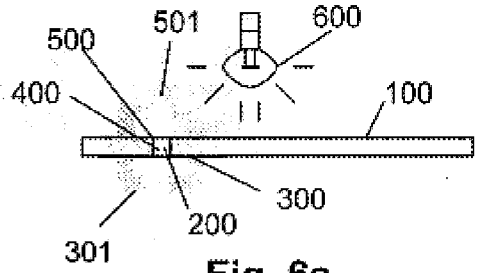
FIGS. 6*a* and 6*b* are a cross section and plan view of the hole in FIG. 5*a* with a light source that will cure the window material.
Figure 5B:
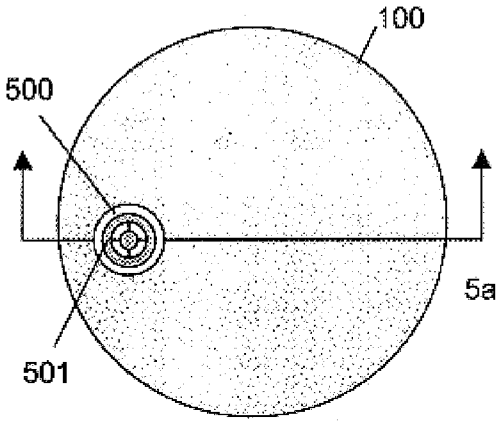
Figure 6B:
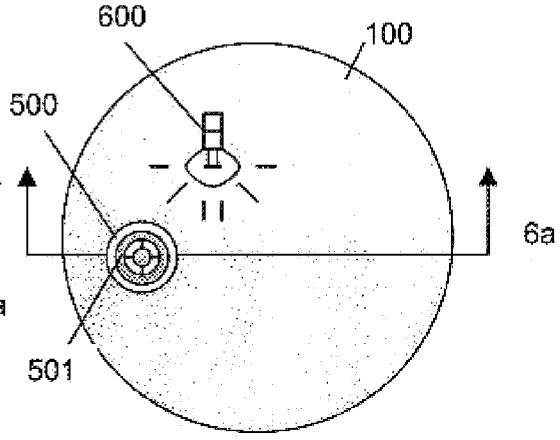
Figure 7A:
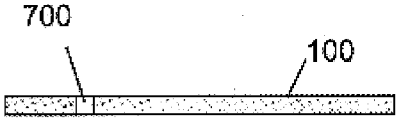
FIGS. 7*a* and 7*b* are a cross section and plan view of a polishing pad with a window cast in place.
Figure 8A:
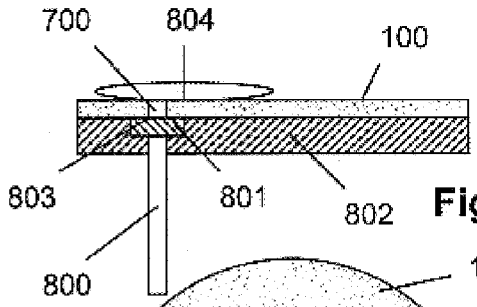
FIGS. 8*a* and 8*b* are a cross section and plan view of a light pipe that may be used to transmit and receive light through the window that has been reflected off a wafer.
Figure 7B:
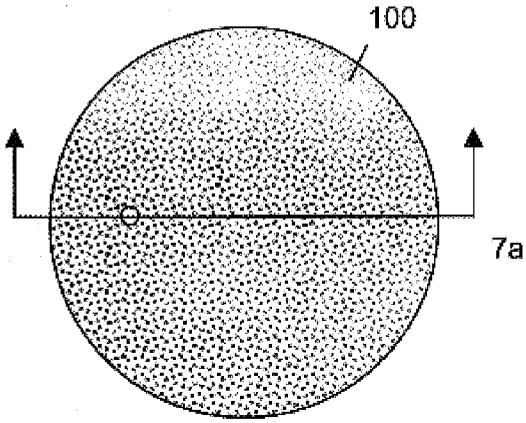
Figure 8B:
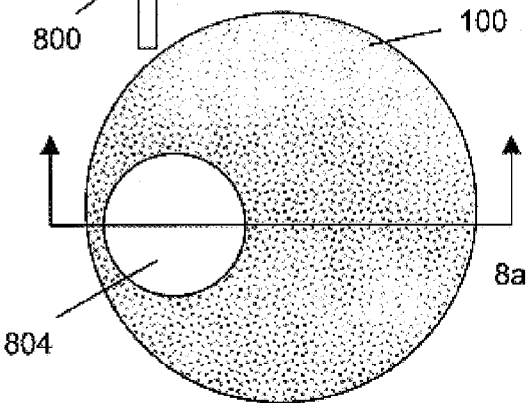

An improved polishing apparatus and method utilized in the polishing of a semiconductor substrate and thin films formed thereon will now be described. In the following description, numerous specific details are set forth illustrating Applicants' best mode for practicing the present invention and enabling one of ordinary skill in the art to make and use the present invention. It will be obvious, however, to one skilled in the art that the present invention may be practiced without these specific details. In other instances, well-known machines and process steps have not been described in detail in order to avoid obscuring the present invention.

A process for creating a window 700 in a polishing pad 100 will now be presented with reference to FIGS. 1*a*–10. A polishing pad 100, typically comprising urethane, may have one or more layers depending on the characteristics of the particular wafer 804 being planarized and the desired results. For example, an IC1000 polishing pad 100 may be used alone or may be laid over a Suba IV backing pad to create a single polishing pad 100. The IC1000 polishing pad and Suba IV backing pad are made commercially available from Rodel Corporation (Rodel) with offices in Phoenix, Ariz. Other types of polishing pads 100, as one skilled in the art will recognize, may also be used with the invention.

The invention may be used for creating any number of windows 700 at any number of different locations on the polishing pad 100. A hole 200 for each desired window 700 needs to be created in the polishing pad 100 (step 1001). The particular method for creating the hole 200, e.g. punching or laser, is not critical as long as the method accurately positions the hole 200 and creates easily bonded to walls in the hole for the window material 400. The position and number of holes 200 may be determined by the position and number of windows 700 needed by the metrology system in the CMP tool to be used.

Grooves (not shown) are conventionally cut into the polishing pad 100 to facilitate slurry transportation during the planarization process, and in some cases it may be desirable to position the window 700 relative to the grooves in a particular manner. For example, it may be desirable to position the window across a slurry groove, at the intersection of two or more grooves, or on an area away from any grooves. However, the present invention is not limited to any particular position of the window 700 on the polishing pad 100, and in fact the window 700 may be placed in any position relative to slurry grooves or any other features on the polishing pad 100.

The hole 200 does not necessarily have to extend all the way through the polishing pad 100. For example, if a two layer polishing pad 100 is used, the hole 200 for the window 700 may be made only through the top layer. The bottom layer may then be adapted, for example, to receive an optical probe positioned adjacent the window 700.

The sides of the hole in the polishing pad 100 will form the sides of the mold for casting the window 700. After creating the holes 200, if the walls are not sufficiently cleaned, they may be trimmed to remove excess or loose polishing pad 100 material. Loose material in the hole 200 may cause obstructions in the window 700 and reduce the strength of the bond between the window 700 and the polishing pad 100. In addition, the rough sides of the hole 200 may catch air bubbles that also reduce the optical qualities of the window 700.

The size of hole(s) 200 will vary depending on the particular needs of the metrology instrument in taking the desired measurements. A smaller hole 200 is less likely to interfere with the planarization process, but makes it more difficult to eliminate bubbles and to properly align metrology instruments through the hole 200. While the invention is not limited to any particular hole size, a hole size of about 3 mm in diameter has been found to be sufficient for taking optical measurements without noticeably interfering with the planarization process.

Figure 9A:
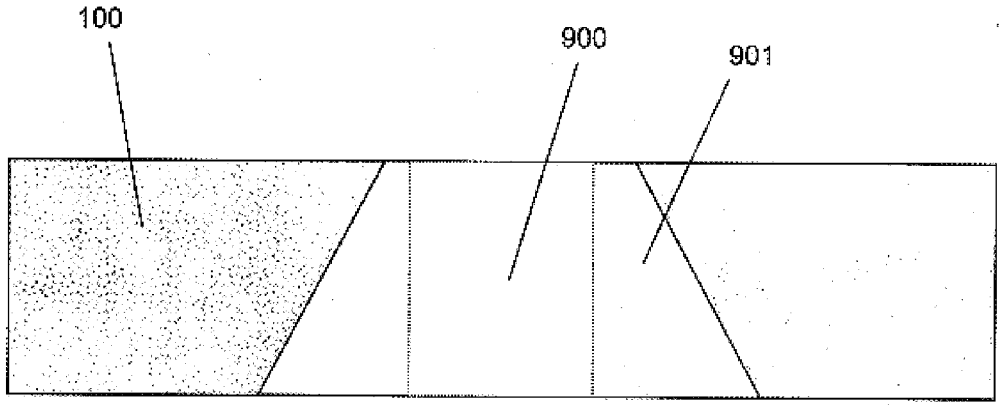
FIG. 9*a* is a cross section of a window in a polishing pad.
Figure 9B:
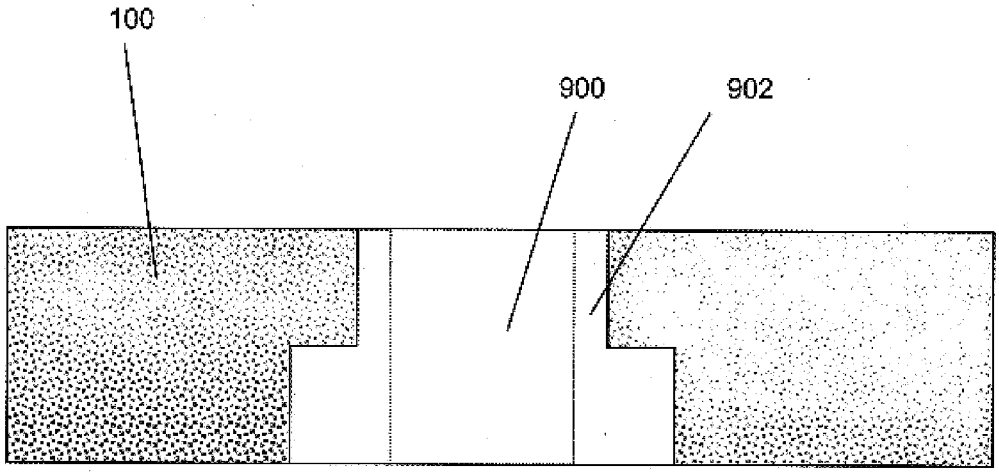
FIG. 9*b* is a cross section of a window in a polishing pad.
Figure 10:
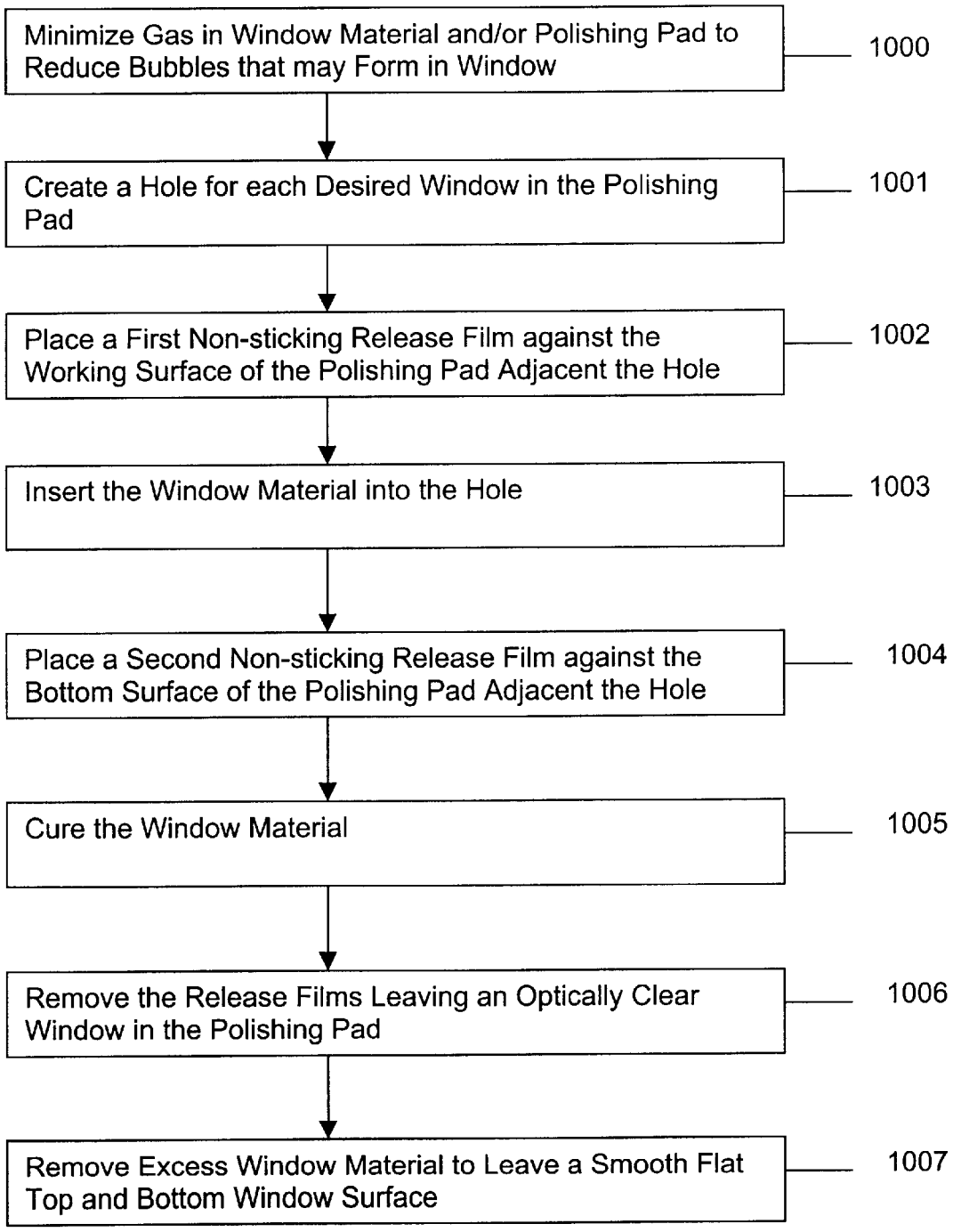
FIG. 10 is a flowchart for casting a window into a polishing pad according to one embodiment of the invention.

The hole(s) 901, 902 do not have to be cylindrical, as illustrated in FIGS. 9*a* and 9*b*. While cylindrical holes are the easiest to manufacture, shapes other than cylindrical will have a larger surface at the window-pad interface thereby improving the bonding of the window to the polishing pad 100. In addition, applicants have discovered that most of the defects in the window occur near the window-pad interface. Various cross sections for the hole(s) 901, 902 may thus be chosen that will allow the top of the window to remain small, thus minimizing the impact the window has on the planarization process, while moving the window-pad interface away from the central region 900 of the window used for optical communication. One skilled in the art will recognize that the hole(s) 901, 902 may be as shown in FIGS. 9*a* and 9*b,* flipped upside down or that other shapes for the holes may be used to practice the invention.

A non-sticking release film 300 may be placed against the working surface of the polishing pad 100 to form the top surface for the mold of the window 700 (step 1002). An adhesive may be used to hold the release film 300 in place during the casting process. However, an adhesive may leave contaminates on the working surface of the polishing pad 100 after being removed. A preferred alternative is to lightly press the release film 300, without contorting the polishing pad 100, against the polishing pad 100 during the casting process with mechanical means 301. This has the advantage of not contaminating the working surface of the polishing pad 100. The release film 300 is preferably transparent to allow the window material 400 to be easily exposed and cured by light. The release film 300 is also preferably smooth so that the top surface of the window is smooth once the release film 300 has been removed. The release film 300 may comprise a polyester film, such as mylar, a fluorocarbon polymer or any other material that does not stick to the window material 400.

The polishing pad 100 is preferably turned so that the working surface is face down if it is not already in this position. With the working surface of the polishing pad 100 face down, gas bubbles in the window material 400 will rise away from the top surface of the window 700. This is desirable since bubbles near the top surface of the window 700 may create voids on the top surface of the window 700 as the top surface of the window 700 is worn away during the CMP process. The voids in the top surface of the window 700 may trap debris, slurry or other particles that can reduce the optical properties of the window 700.

The hole 200 and release film 300 form the side-walls and bottom for a mold of the window 700 respectively. The mold is filled with a window material 400 that when cured bonds to the polishing pad 100 and forms an optically clear window 200.

The window material 400 is preferably selected to form a window 700 with about the same hardness as the polishing pad 100, e.g. about 35 to 55 on a shore "D" gauge for conventional polishing pads 100. If the polishing pad 100 is softer than the window 700, the polishing pad 100 will compress to a greater extent during the planarization process thereby causing the window 700 to protrude above the polishing pad 100. The protruding window 700 might scratch or damage the wafer 804. In addition, a strain along the pad-window interface will occur if the polishing pad 100 and window 700 compress differently. The strain over time may weaken the bond between the polishing pad 100 and window 700 and cause imperfections to develop along the interface. The hardness of the window 700 and polishing pad 100 are preferably within about +/−10 on the shore "D" gauge of each other.

The window material 400 is preferably selected to form a window 700 with about the same wear ability as the polishing pad 100. Applicants have discovered that if the polishing pad 100 wears faster than the window 700, the window 700 will eventually protrude and may scratch the front face of the wafer 804. Applicants have also discovered that if the polishing pad 100 wears slower than the window 700, the window 700 will eventually become recessed and trap debris thereby attenuating transmitted or received light.

Another factor in selecting the window material 400 is selecting one that does not stain from the slurry or material removed from the front surface of the wafer 804. A window 700 that stains will greatly limit the light transmitting abilities of the window 700. The window 700 should also not react with the slurry being used. Conventional slurry typically has a high, neutral or low pH for planarizing oxide, copper or tungsten respectively. Although a window 700 may be created that does not react with a particular slurry pH, it is preferred that the window 700 does not react with a wide range of pH's. This allows the same polishing pad 100 and window 700 to be used in a wider range of processes that use slurries with different pH's.

The window 700 needs to be held securely in place to prevent crevices or other imperfections from occurring at the window-pad interface. Crevices or other imperfections may accumulate debris or used slurry that may hinder optical communication between the front surface of the wafer 804 and metrology instruments positioned on the back side of the polishing pad 100. Therefore, the window material 400 is preferably selected that has a strong bond with the desired polishing pad 100 once the window material 400 has been cured. The window material 400 prior to curing is preferably a low viscosity material that will enter the porous polishing pad 100 thereby increasing the contact area for bonding to the polishing pad 100. A high viscosity window material 400 will not enter the porous structure of the polishing pad 100 making it difficult to maintain an effective wetting of the walls of the hole.

The window 700 should allow the range of frequencies needed by the metrology instruments used to pass with minimal attenuation and distortion. However, a window 700 that passes a broad spectrum of light will be the most versatile and function with metrology instruments that require a wider light spectrum to operate. For the best transmission of optical signals in the CMP environment, windows that readily transmit Ultra Violet are preferred.

Based upon the above factors identified by the inventors as being desirable for the window 700, the inventors have discovered that the window material 400 preferably comprises an optical grade acrylic-urethane oligomer. Suitable window materials 400 are sold under the tradename OP29 or OP29V and are made commercially available from Dymax Corporation located in Torrington, Conn. This material has the advantage of being easily and quickly cured by UV or bright visible light 600 after about 5 seconds of exposure after being cast into the hole 200 in the polishing pad 100.

After inserting the window material 400 into the mold (step 1003), the mold may then be sealed by applying a second release film 500 (step 1004) to form the bottom of the mold. An adhesive or mechanical means may be used to place a gentle pressure on the second release film 500. Care should be taken to avoid introducing bubbles into the window material 400 as the release film 500 of the mold is moved into position against the bottom of the polishing pad 100.

The window material 400 may then be cured according to the requirements of the particular window material 400 being used (step 1005). If the preferred material of OP29V is used, it may be cured with UV light 600 after only about five to fifteen seconds of exposure.

One potential problem in casting the window 700 according to the above described process is accidentally producing bubbles in the window 700. The bubbles have a different index of refraction from the window material 400 and interfere with optical communications through the window 700. The window material 400 and the polishing pad 100 typically contain a certain amount of undesirable adsorbed gasses. Bubbles can form in the window material 400 by displacement of adsorbed gasses from the adjacent polishing pad 100. The quality of the window 700 may therefore be improved by reducing the amount of gas displaced into the window material 400 from the polishing pad 100 and by reducing the amount of gas initially in the window material 400.

The gas accumulated by the window material 400 from the polishing pad 100 may be reduced by warming the polishing pad 100 and releasing some of its absorbed gas prior to contact with the window material 400. The walls of the hole 200 that form the mold may also be treated, for example by Argon bombardment, to further limit gas from entering the window material 400 from the polishing pad 100. By filling the hole 200 from the bottom and flowing excess window material 400 out of the hole 200, additional bubbles may be purged.

Another technique for reducing the gas in the window material 400 and the polishing pad 100 requires storing the window material 400 and/or the polishing pad 100 in a vacuum chamber prior to use. To further minimize the bubbles that form in the window 700, the entire process for casting the window 700 may be performed in a vacuum.

The top and bottom release films 300, 500 may be removed after curing the window material 400 thereby leaving the cast window 700 in the polishing pad 100 (step 1006). Excess material from the casting process may be scraped or ground off. The top and bottom window surface may be conditioned to leave a flat smooth surface that is preferably coplanar with the top and bottom surfaces of the polishing pad 100 (step 1007). As a slight variation, a plug may be inserted into the hole 200 near the working surface to prevent the window material 400 from becoming coplanar with the working surface of the polishing pad 100. This allows the top surface of the window 700 to be recessed from the working surface of the polishing pad 100 thereby preventing the window 700 from contacting and possibly damaging the front surface of the wafer 804. It also limits wear of the window 700 and allows for the rinsing of the window surface during the CMP process.

In another embodiment of the invention, the hole for casting the window 700 may be created in a cake (conventionally a cylinder of cured polishing pad material longer than about 100 mm). The hole may be created, for example, by core drilling, laser, water jet, etc. The hole is then filled with window material and may be thermally or UV cured as described above. The length of the cake may need to be reduced from conventional polishing pad cakes depending on the particular window material used and the required curing method for that material. Once the window material has cured, the cake may be skived into individual polishing pads of a desired width each having a window.

In another embodiment, a window 700 may be formed in a multilayer polishing pad where the window 700 has a hardness at various layers that roughly equal the hardness of corresponding layers of the polishing pad. By roughly matching the hardness at various layers of the window with the hardness at various layers of the polishing pad, the shear forces at the window-polishing pad interface may be reduced when a compression force is applied to the window in the polishing pad. One example of creating a window with varying hardness is to use a UV curable material and only fully cure the top layer of the window. By removing the UV source before the bottom layer of the window is fully cured, the bottom layer will remain softer than the top layer. One of ordinary skilled in the art will be able to determine other methods of creating windows that vary in hardness along the length of the window to match the hardness profile of the multilayer polishing pad.

The window 700 of the invention is very versatile and may be used in conjunction with any number of different means for passing light to and from the window 700 and a metrology instrument. One example of a means for passing light between the window 700 and a metrology instrument is a fiber-optic cable 800. As a specific example, a fiber-optic cable 800 may be mounted to a polishing platen 802 (either rigid or flexible) with a fixture 801. When the polishing pad 100 is mounted to the platen 802 with pressure sensitive adhesive, the window 700 (without adhesive) is simply aligned to the fiber-optic cable 802.

An improvement is to use a small amount of optical coupling gel 803 between the window 700 and the light pipe 800. A suitable gel 803 is manufactured by Nye Lubricants, Inc. from New Bedford, Mass. under the name of Optical Gel-OCK-451. This gel is a soft crosslinked material somewhat resistant to traveling under the polishing pad 100 when stressed. This material is typically sold in a self-mixing syringe loaded with optical coupling resin and stays soft once applied and cured between the window 700 and the end of the fiber-optic cable 800. One skilled in the art will recognize that other suitable gels or coupling means may be used.

As part of a conventional CMP process, a wafer 804 is pressed against the polishing pad 100 while relative motion is created between the wafer 804 and the polishing pad 100. Slurry is conventionally introduced between the wafer 804 and the polishing pad 100 to increase the removal rate of material from the front surface of the wafer 804. The invention allows the front surface of the wafer 804 to be interrogated through the polishing pad 100 while the wafer 804 is being planarized. Since the number and placement of the windows 700 in the polishing pad 100 may be easily customized by the invention, the invention may be used with a variety of metrology systems. The invention is particularly useful for broad band light applications since the window 700 of the invention may easily be created for passing a broad band spectrum, but may also be used for narrow band or monochromatic light applications. The information gained through the window 700 may be used to alter or even terminate the planarization process of the wafer 804. CMP tools and metrology systems that may be used with the invention are well known in the art and will therefore not be discussed in detail.

While the invention has been described with regard to specific embodiments, those skilled in the art will recognize that changes can be made in form and detail without departing from the spirit and scope of the invention. For example, one skilled in the art will realize the process as described may be used for creating a window 700 in a variety of abrasive members and is not limited to polishing pads 100 for CMP tools.

We claim:

1. A process for creating a window in a polishing pad having a working surface and a bottom surface comprising the steps of:

a) creating a hole in the polishing pad at a location on the polishing pad where the window is desired;

b) filling the hole with a window material; and c) insitu photochemically curing the window material to form a window inside the hole having a top surface and a bottom surface, the window having a "D" shore gauge within ±10 of the "D" shore gauge of the polishing pad.

2. The method of claim 1 wherein the hole is created in the polishing pad by punching or drilling.

3. The method of claim 1 wherein the hole is created in the polishing pad with a laser.

4. The method of claim 1 further comprising the step of:

d) prior to curing the window material, turning the polishing pad so that the working surface is face-down and the bottom surface is face-up.

5. The method of claim 1 further comprising the step of:

d) positioning a first release film against the working surface of the polishing pad covering the hole prior to filling the hole with window material.

6. The method of claim 1 further comprising the step of:

d) positioning a second release film against the bottom surface of the polishing pad covering the hole after filling the hole with window material but before curing the window material.

7. The method of claim 1 further comprising the step of:

e) after the window material has been cured, conditioning or grinding the top surface of the window until the top surface is substantially coplanar with the corresponding working sure of the polishing pad.

8. The method of claim 1 wherein the step of filling the hole with a window material comprises the step of filling the hole with a light curable optically clear acrylic.

9. The method of claim 1 wherein the window material comprises an optical grade acrylic-urethane oligomer.

10. The method of claim 1 wherein the window material comprises an optical grade acrylic-epoxy oligomer.

11. The method of claim 1 further comprising the step of:

d) degassing the polishing pad or the window material.

12. The method of claim 1 wherein the window wear at substantially the same rate as the polishing pad.

13. The method of claim 1 wherein the top surface of the window is coplanar with the working surface of the polishing pad.

14. A process for creating a window in a polishing pad having a working surface and a bottom surface comprising the steps of:

a) creating a hole in a cake of polishing pad material at a location where the window is desired:

b) filling the hole with a window material;

c) photochemically curing the window material; and d) skiving the cake into individual polishing pads each having a window.

15. A process for creating a window in a polishing pad having a working surface and a bottom surface comprising the steps of:

a) creating a hole in a cake of polishing pad material at a location where the window is desired;

b) filling the hole with a window material;

c) endothermally or exothermally curing the window material; and d) skiving the cake into individual polishing pads each having a window.

16. An abrasive member for removing material from a workpiece comprising:

a) a polishing pad having a predetermined "D" shore gauge and comprising a working surface and a bottom surface and an aperture extending through the polishing pad from the working surface to the bottom surface; and b) a photochemically cured window cast insitu within the aperture, the window having a window top surface and a window bottom surface and a "D" shore gauge within ±10 of the predetermined "D" shore gauge of the polishing pad.

17. The abrasive member of claim 16 wherein the window comprises an optical grade acrylic-urethane oligomer.

18. The abrasive member of claim 16 wherein the window comprises an optical grade acrylic-epoxy oligomer.

19. The abrasive member of claim 16 wherein the top surface of the window wears away at substantially the same rate as the working surface of the polishing pad.

20. The abrasive member of claim 16 wherein the top surface of the window is coplanar with the working surface of the polishing pad.

21. An abrasive member for removing material from a workpiece comprising:

a) a polishing pad with an aperture; and b) a window in the aperture, wherein the window comprises an optical grade acrylic-urethane oligomer.

22. An abrasive member for removing material from a workpiece comprising:

a) a polishing pad with an aperture; and b) a window in the aperture, wherein the window comprises an optical grade acrylic-epoxy oligomer.

23. An abrasive member for removing material from a workpiece comprising:

a) a polishing pad with an aperture; and b) a window in the aperture, wherein the window comprises a UV curable material.

24. An abrasive member for removing material from a workplace comprises:

a) polishing pad with an aperture; and b) a window in the aperture wherein the window comprises an optical grade acrylic-urethane oligomer and wears away at substantially the same rate as the polishing pad.

25. An abrasive member for removing material from a workplace comprising:

a) a polishing pad with an aperture; and b) a window in the aperture wherein the window comprises an optical grade acrylic-epoxy oligomer and wears away at substantially the same rate as the polishing pad.

26. The method of claim 8 wherein the step of filling the hole with a light curable optically clear acrylic comprises the step of filling the hole with an optical grade acrylic epoxy oligomer.

27. The method of claim 8 wherein the step of filling the hole with a light curable optically clear acrylic comprises the step of filling the hole with an optical grade acrylic urethane oligomer.

28. The abrasive member of claim 16 wherein the photochemically cured window comprises a top surface recessed with respect to the working surface of the polishing pad.

* * * * *

UNITED STATES PATENT AND TRADEMARK OFFICE

CERTIFICATE OF CORRECTION

PATENT NO. : 6,685,537 B1
DATED : February 3, 2004
INVENTOR(S) : Clinton O. Fruitman et al.

It is certified that error appears in the above-identified patent and that said Letters Patent is hereby corrected as shown below:

Column 9,
Line 1, delete “wear” and insert -- wears --.

Column 24,
Line 2, delete “workplace comprises” and insert -- workpiece comprising --.

Signed and Sealed this

Eighteenth Day of May, 2004

JON W. DUDAS
*Acting Director of the United States Patent and Trademark Office*